US006508679B2

(12) United States Patent
Han et al.

(10) Patent No.: US 6,508,679 B2
(45) Date of Patent: Jan. 21, 2003

(54) POWER CONNECTOR FOR DC MICROWAVE OVEN

(75) Inventors: Yong-woon Han, Kunpo (KR); Seong-deog Jang, Suwon (KR); Kwang-seok Kang, Suwon (KR); Dae-sung Han, Kyungki-do (KR); Jin-ho Kim, Suwon (KR); Han-seong Yoo, Yongin (KR); Han-sung Kang, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/756,238

(22) Filed: Jan. 9, 2001

(65) Prior Publication Data

US 2001/0027064 A1 Oct. 4, 2001

(30) Foreign Application Priority Data

Mar. 31, 2000 (KR) ..... 00/17038

(51) Int. Cl.[7] ..... H01R 13/502

(52) U.S. Cl. ..... 439/696; 439/804; 439/934; 439/892; 439/908; 439/488

(58) Field of Search ..... 439/887, 804, 439/488, 469, 449, 696, 718, 934, 892, 908, 491, 621; 174/151, 138 F

(56) References Cited

U.S. PATENT DOCUMENTS

| | | | | | |
|---|---|---|---|---|---|
| 1,993,100 | A | * | 3/1935 | Hoffmann | 439/804 |
| 2,892,175 | A | * | 6/1959 | Frey | 174/112 |
| 3,988,053 | A | * | 10/1976 | Dodenhoff | 439/887 |
| 4,341,920 | A | * | 7/1982 | Reich | 439/536 |
| 4,415,044 | A | * | 11/1983 | Davis | 439/718 |
| 4,913,981 | A | * | 4/1990 | Hynes et al. | 439/491 |
| 4,926,110 | A | * | 5/1990 | Yoon | 439/621 |
| 5,521,359 | A | * | 5/1996 | Bone | 219/485 |
| 6,288,886 | B1 | * | 9/2001 | Sato et al. | 361/302 |

* cited by examiner

*Primary Examiner*—Neil Abrams
*Assistant Examiner*—Phuong Dinh
(74) *Attorney, Agent, or Firm*—Robert E. Bushnell, Esq.

(57) ABSTRACT

Disclosed is a power connector for a DC microwave oven, suitable for connecting power cords which are led from a DC power source and have positive and negative polarities, respectively, to a component arranged in a device chamber which is defined in a body of the DC microwave oven. The power connector comprises a connector body fixedly secured to a rear plate of the body of the DC microwave oven; power terminals for positive and negative polarities, the power terminals projecting into the device chamber from a rear surface of the connector body; and power cord connecting means projecting from a front surface of the connector body, for enabling the power cords which are led from the DC power source and have positive and negative polarities, to be connected thereto, respectively.

20 Claims, 3 Drawing Sheets

POWER CONNECTOR FOR DC MICROWAVE OVEN

CLAIM OF PRIORITY

This application makes reference to, incorporates the same herein, and claims all benefits accruing under 35 U.S.C. §119 from my application POWER CONNECTOR OF A DC MICROWAVE OVEN filed with the Korean Industrial Property Office on Mar. 31, 2000 and there duly assigned Ser. No. 17038/2000.

BACKGROUND OF THE INVENTION

1. Field of the Invention

The present invention relates to a DC microwave oven, and more particularly, to a power connector for a DC microwave oven, which enables DC power cords having applied thereto a high current to be connected to a component inside the DC microwave oven in such a way as to accomplish maximum surface contact, thereby improving connectability of the power cords and minimizing power loss through the power cords.

2. Description of the Related Art

Generally, in a microwave oven, AC power which is supplied from a utility AC power source, is transformed into a high voltage and then, is used to drive a magnetron. Microwaves which are produced in the magnetron and have a high frequency, are radiated toward a food, and the food is cooked by heat which is generated by radiation of the microwaves.

In such an AC microwave oven, there is defined a device chamber. A high voltage transformer for driving the magnetron and a magnetron driving circuit which comprises a plurality of micro-switches for controlling an operation of the high voltage transformer, are disposed in the device chamber of the AC microwave oven. The high voltage transformer and the magnetron driving circuit operate by receiving utility AC power from the outside through a power connector.

Due to the fact that the power connector for the AC microwave oven is configured so as to receive a low current in view of AC power of 100V or 220V, power cords are not so thick that terminal connection works of the power cords can be implemented in a convenient manner.

On the other hand, recently, a DC microwave oven which uses DC power, has been disclosed in the art to allow a user to conveniently cook a food in mobile means such as a motor vehicle or in an outdoor field. In order to receive from a DC power source such as a battery DC voltage which is used in such a DC microwave oven, power cords each of which has a cross-sectional area of no less than 22 $mm^2$, must be used and connected to the DC power source such as a battery, so as to stand a high current of 80A to 100A in a sufficient manner.

However, on the contrary to the fact that, in the DC microwave oven, bare wires of the power cords which are connected to the DC power source and have the cross-sectional area of no less than 22 $mm^2$, should be connected to the DC microwave oven with sufficient surface contact, because a power connector for connecting the thick power cords with sufficient surface contact is not disclosed in the art at the present stage, connectability of the power cords which are led from the DC power source, is deteriorated, whereby power loss is increased and a dangerous situation can occur in the course of using the DC microwave oven.

SUMMARY OF THE INVENTION

Accordingly, the present invention has been made in an effort to solve the problems occurring in the related art, and an object of the present invention is to provide a power connector for a DC microwave oven, which enables power cords led from a DC power source having applied thereto a high current to be connected to a component inside the DC microwave oven in such a way as to accomplish maximum surface contact, thereby improving connectability of the power cords and minimizing power loss through the power cords.

In order to achieve the above object, according to the present invention, there is provided a power connector for a DC microwave oven, suitable for connecting power cords which are led from a DC power source and have positive and negative polarities, respectively, to a component arranged in a device chamber which is defined in a body of the DC microwave oven, the power connector comprising: a connector body fixedly secured to a rear plate of the body of the DC microwave oven; power terminals for positive and negative polarities, the power terminals projecting into the device chamber from a rear surface of the connector body; and power cord connecting means projecting from a front surface of the connector body, for enabling the power cords which are led from the DC power source and have positive and negative polarities, to be connected thereto, respectively.

By the features of the present invention, in the case that AWG4 power cords which are led from a DC power source such as a battery and each of which has a cross-sectional area of 22 $mm^2$, are connected to a component which is arranged in a device chamber of a DC microwave oven, it is possible to realize a power connector which accomplishes maximum surface contact and reliable connection of the power cords each having a substantial thickness, whereby connectability of the power cords is improved and power loss through the power cords is minimized.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
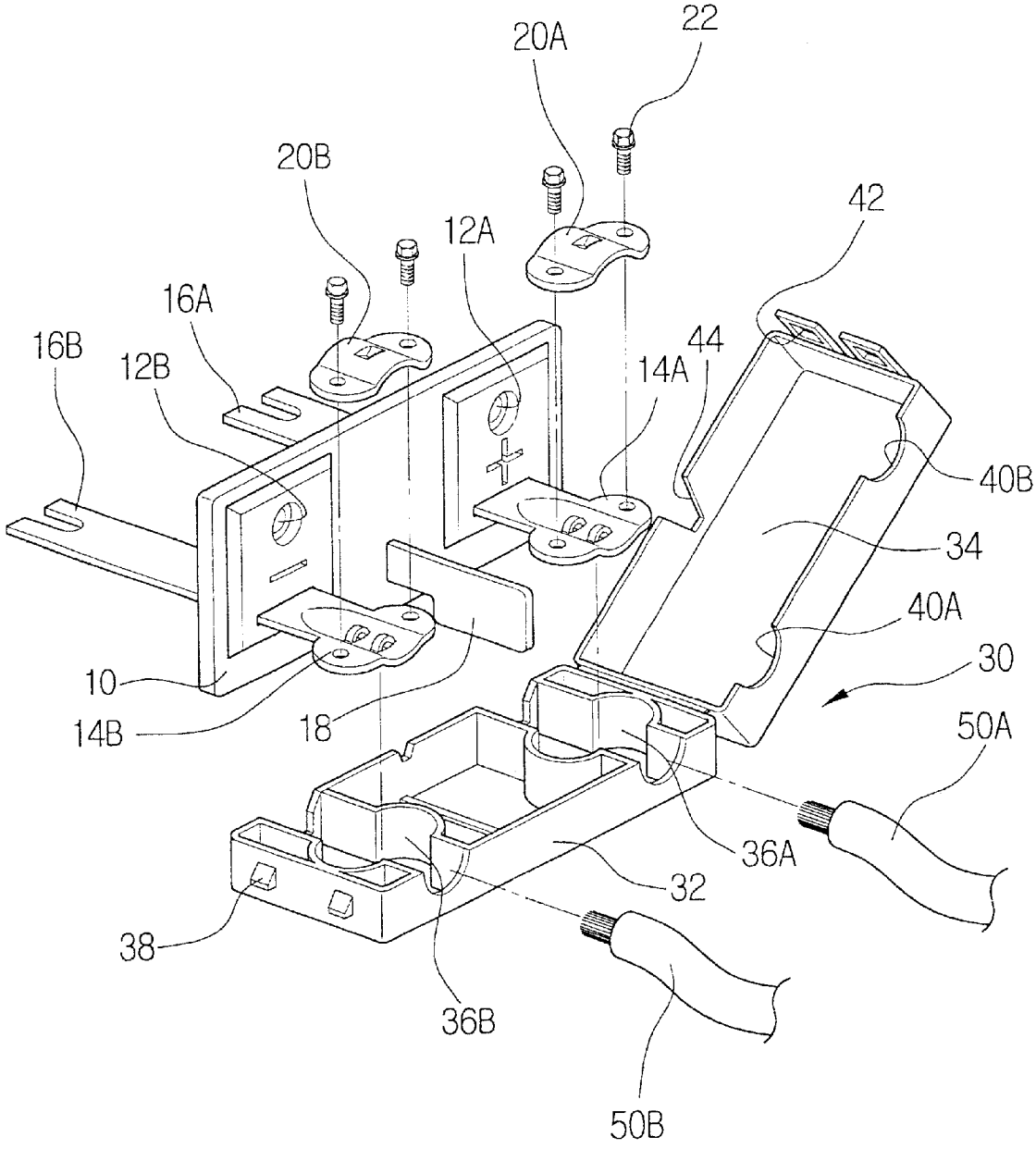
FIG. 1 is an exploded perspective view illustrating an entire construction of a power connector for a DC microwave oven in accordance with an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
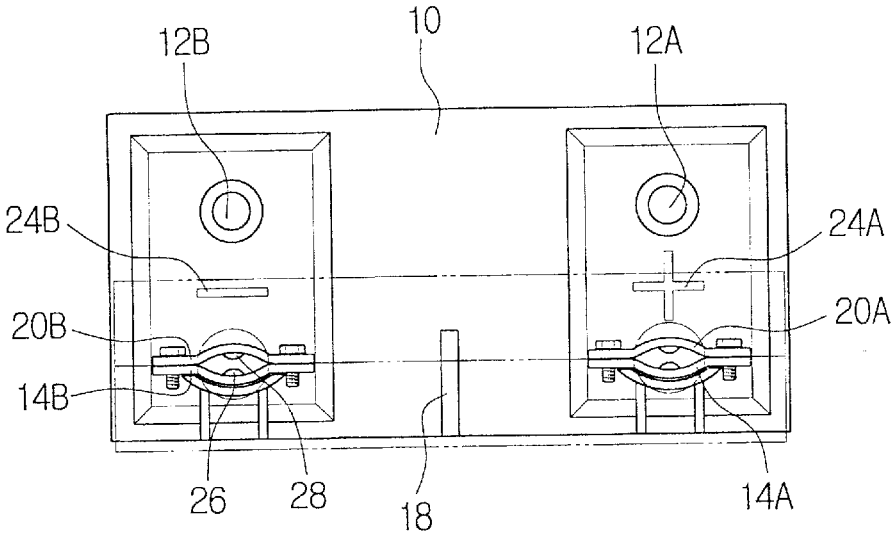
FIG. 2 is a front view illustrating an inner connection pattern of the power connector of FIG. 1.
Figure 3:
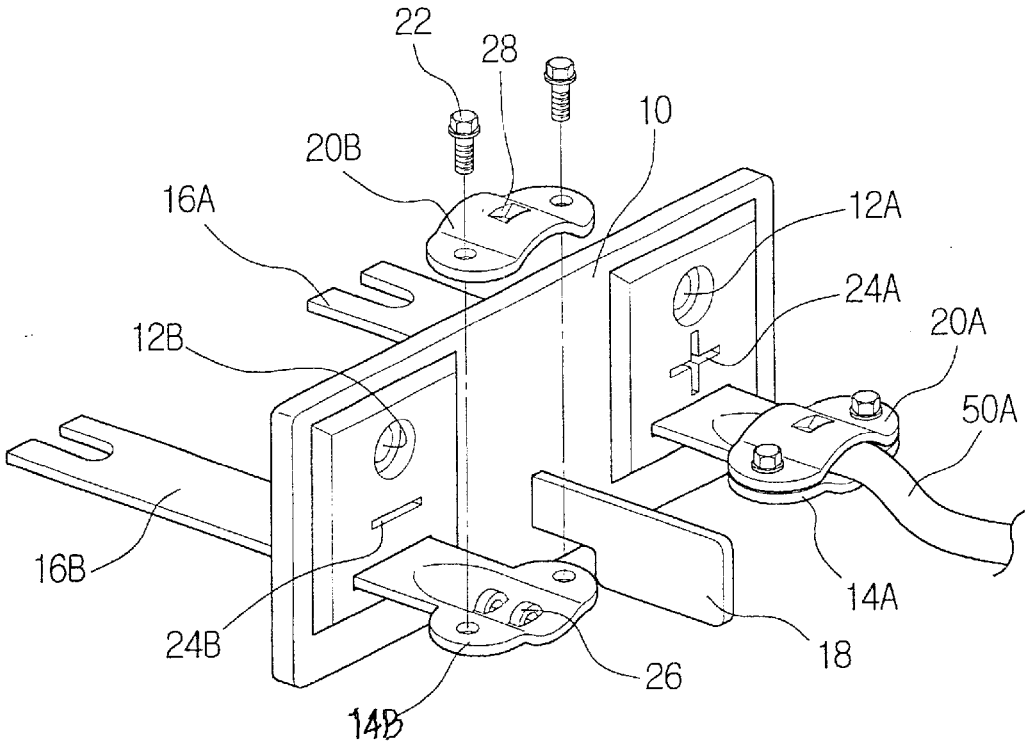
FIG. 3 is a perspective view illustrating a state wherein a power cord is connected to the power connector according to the present invention.
Figure 4:
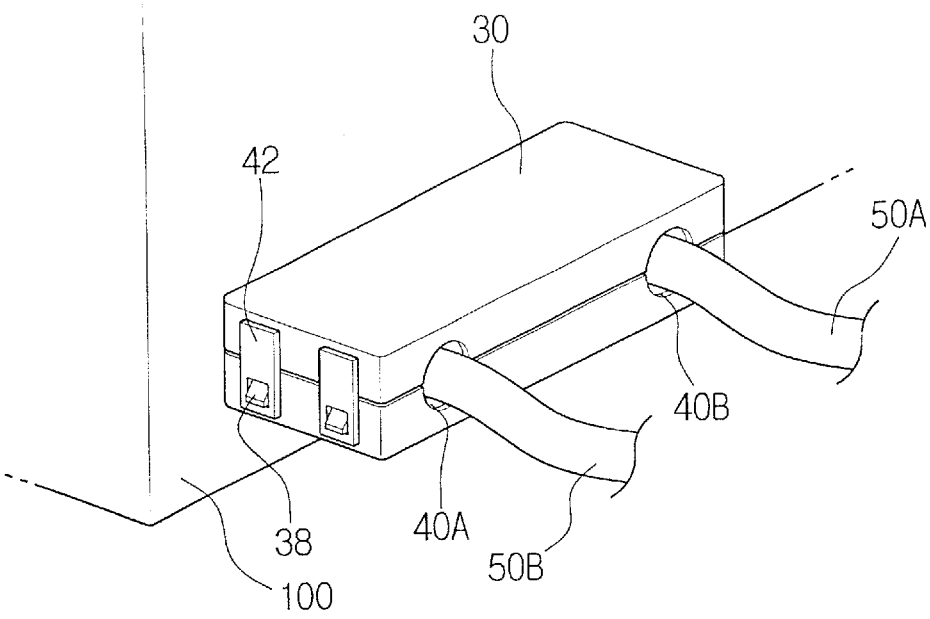
FIG. 4 is a perspective view illustrating an example in which the power-connector according to the present invention is attached to the DC microwave oven.

FIG. 1 is an exploded perspective view illustrating an entire construction of a power connector for a DC microwave oven in accordance with an embodiment of the present invention; FIG. 2 is a front view illustrating an inner connection pattern of the power connector of FIG. 1; FIG. 3 is a perspective view illustrating a state wherein a power cord is connected to the power connector according to the present invention; and FIG. 4 is a perspective view illustrating an example in which the power connector according to the present invention is attached to the DC microwave oven.

As shown in FIGS. 1 through 4, a power connector for a DC microwave oven according to the present invention includes a connector body 10. Threaded holes 12A and 12B are defined through the connector body 10. The connector body 10 is mounted at a predetermined location to a rear end of the DC microwave oven by means of screws which are threaded through the threaded holes 12A and 12B. Two wire connecting sections 14A and 14B project from a front surface, to enable bare wires of two power cords 50A and 50B which respectively have positive polarity and negative polarity and are led from a DC power source such as a battery, to be respectively connected thereto.

The two wire connecting sections 14A and 14B are integrally formed through the connector body 10 with two power terminals 16A and 16B, respectively, which project from a rear surface of the connector body 10 to be led into a device chamber which is defined in the DC microwave oven.

The wire connecting section 14A is used for enabling the bare wire of the power cord 50A which has positive polarity, to be connected thereto, and the wire connecting section 144B is used for enabling the bare wire of the power cord 50B which has negative polarity, to be connected thereto.

Also, a terminal isolating plate 18, which is made of a non-conductive material, for example, synthetic resin such as plastic, is integrally formed with the connector body 10 in a manner such that the terminal isolating plate 18 is interposed between the two wire connecting sections 14A and 14B respectively used for positive polarity and negative polarity and projects from the front surface of the connector body 10 in a direction perpendicular to a plane of the connector body 10. The terminal isolating plate 18 functions to prevent electrical short from occurring due to the fact that the bare wires of the power cords 50A and 50B are connected to the wire connecting section 14A for positive polarity and the wire connecting section 14B for negative polarity, respectively.

Two connecting covers 20A and 20B are respectively locked onto the two wire connecting sections 14A and 14B for positive and negative polarities by means of screws 22 in a manner such that the bare wires of the power cords 50A and 50B are sandwiched therebetween, respectively. The two wire connecting sections 14A and 14B and the two connecting covers 20A and 20B are formed with rounded portions, respectively, to maximize surface contact when the bare wires of the power cords 50A and 50B each having a substantial thickness are connected therebetween.

Further, as shown in FIGS. 2 and 3, first connecting protrusions 26 are formed on inner surfaces of the rounded portions of the wire connecting sections 14A and 14B for positive and negative polarities, to improve connectability of the wire connecting sections 14A and 14B with the bare wires of the power cords 50A and 50B for positive and negative polarities. And, second connecting protrusions 28 are formed on inner surfaces of the rounded portions of the connecting covers 20A and 20B, to improve connectability of the connecting covers 20A and 20B with the bare wires of the power cords 50A and 50B.

Here, the first connecting protrusions 26 which are provided to the wire connecting sections 14A and 14B and the second connecting protrusions 28 which are provided to the connecting covers 20A and 20B, are formed in a manner such that they are alternately positioned when the connecting covers 20A and 20B are locked onto the wire connecting sections 14A and 14B, respectively.

In the meanwhile, between places in which the wire connecting sections 14A and 14B for positive and negative polarities are located on the front surface of the connector body 10 and places in which the threaded holes 12A and 12B are defined in the connector body 10, polarity indicating sections 24A and 24B for indicating positive and negative polarities, respectively, are formed, by an engraving technique, on the front surface of the connector body 10. By this, symbols which correspond to the positive and negative polarities, respectively, are formed on the front surface of the connector body 10.

In order to allow polarities at the connection places to be easily discerned when the power codes 50A and 50B having positive and negative polarities are connected to the wire connecting sections 14A and 14B, respectively, paints which have different colors, are coated on the polarity indicating sections 24A and 24B, respectively . In other words, for example, a red paint is coated, on the polarity indicating section 24A for positive polarity, and a black paint is coated on the polarity indicating section 24B for negative polarity Moreover, an outer case 30 for closing a power cord connection region which is defined in front of the connector body 10, is installed on the front surface of the connector body 10 which supports the two wire connecting sections 14A and 14B. The outer case 30 comprises a case body 32 which has substantially a rectangular receptacle-shaped configuration for closing one half of the power cord connection region and a case cover 34 which is seated on the case body 32 for closing the other half of the power cord connection region. The case body 32 and the case cover 34 are made of a non-conductive resinous material and Integrally connected with each other.

The case body 32 of the outer case 30 is defined with a receiving groove 36A for positive polarity and a receiving groove 36B for negative polarity, which have the same cross-sectional shape as the wire connecting sections 14A and I. The wire connecting section 14A for positive polarity and the wire connecting section 14B for negative polarity are received in the receiving grooves 36A and 36B, respectively, in a state wherein Whey are electrically isolated from each other. Locking projections 38 are formed on outer surfaces of both side walls of the case body 32, and locking holes 42 are defined in outer surfaces of th side walls of the case cover 34, in a manner such that the locking projections 38 of the case body 32 can be locked into the locking holes 42 of the case cover 34, respectively.

In the meantime, a front wall of he case body 32 and a front wall of the case cover 34 cooperatively define introducing holes 40 and 40B for allowing the power cords 50A and 50B for positive and negative polarities to respectively pass therethrough toward the connector body 10. Each of rear walls of the case body 32 and case cover 34 is formed with a depression 44 for accommodating therein the terminal isolating late 18. As described above, the locking holes 42 are defined in outer surfaces of both side walls of the case cover 34, in a manner such that the locking projections 38 of the case body 32 can be locked into the locking holes 42 of the case cover 34, respectively.

Figure 5:
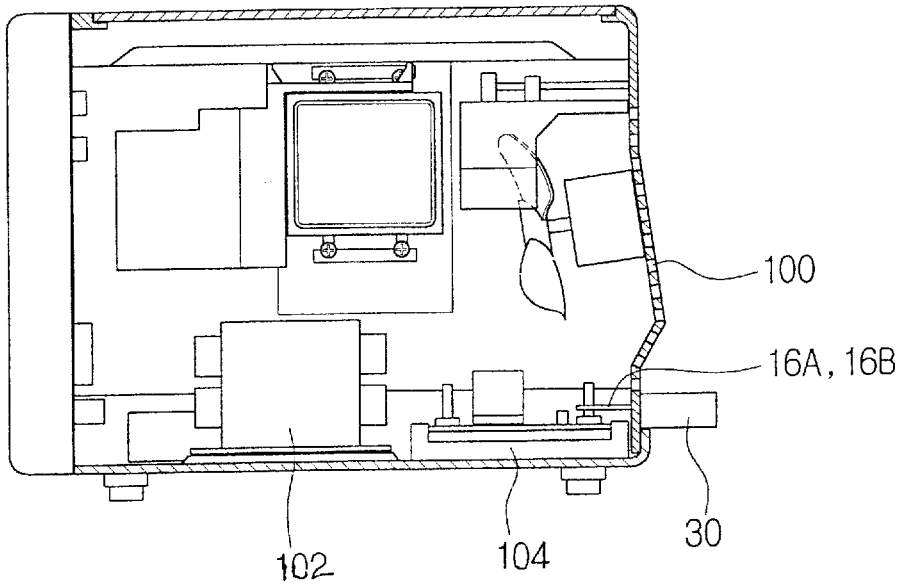
FIG. 5 is a cross-sectional view illustrating a state wherein a power connector is connected to the microwave oven according to the present invention.

In the power connector according to the present invention, constructed as mentioned above, the connector body 10 is mounted to a rear plate 100 of the DC microwave oven by means of the screws which are threaded through the thread d holes 12A and 12B. As shown in FIG. 5, the power terminals 16A and 16B for positive and negative polarities, which project from the rear surface of the connector body 10, are respectively connected to a printed circuit board 104 which is disposed in the device chamber defined in the DC microwave oven and has an inverter circuit for inverting a DC voltage into an AC voltage in order to supply the AC voltage to a high voltage transformer 102.

In this state, the bare wires of the power cords 50A and 50B for positive and negative polarities, which are led from the DC power source such as the battery, are respectively connected to the wire connecting sections 14A and 14B for positive and negative polarities, which project from the front surface of the connector body 10.

Thereupon, the two connecting covers 20A and 20B are locked onto the; two wire connecting sections 14A and 14B, respectively, by means of screws 22. At this time, the bare wires of the power cords 50A and 50B which are connected to the wire connecting sections 14A and 14B and the connecting covers 20A and 20B, are tightly squeezed by the first connecting protrusions 26 which are formed on the inner surfaces of the rounded portions of the wire connecting sections 14A and 14B and the second connecting protrusions 28 which are formed on the inner surfaces of the rounded portions of the connecting covers 20A and 20B, whereby connectability of the power cords 50A and 50B is improved and reliable connection of the power cords 50A and 50B is ensured.

On the other hand, if the bare wires of the power cords 50A and 50B are connected to the wire connecting sections 14A and 14B and the connecting covers 20A and 20B, respectively, the front surface of the connector body 10 is closed by the outer case 30.

That is to say, after connection parts of the power cords 50A and 50B with the wire connecting sections 14A and 14B and the connecting covers 20A and 20B are respectively received in the receiving grooves 36A and 36B which are defined in the case body 32 of the outer case 30, as shown in FIG. 4, the locking projections 38 of the case body 32 are respectively locked into the locking holes 42 of the case cover 34, whereby it is possible to prevent foreign substances or moisture from the outside contaminating the bare wires of the power cords 50A and 50B or the wire connecting sections 14A and 14B.

As a result, by the present invention, advantages are provided in that, since a power connector for reliably connecting, with maximum surface contact, power cords which are led from a DC power source having generated therefrom a high current and each of which has a substantial thickness, is realized, connectability of the power cords is improved and power loss through the power cords is minimized.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A power connector for a DC microwave oven, suitable for connecting power cords which are led from a DC power source to a component arranged in a device chamber which is defined in a body of the DC microwave oven, the power connector comprising:

a connector body fixedly secured to a rear plate of said body of said DC microwave oven;

power terminals projecting into said device chamber from a rear surface of said connector body; and power cord connecting means projecting from a front surface of said connector body for enabling said power cords to be connected to respective said power terminals, said power cord connecting means comprising wire connecting sections and connecting covers, each of said connecting covers coupled to each of said wire connecting sections in a manner such that inner surfaces of said wire connecting section and said connecting cover surround and secure the power cord.

2. The power connector of claim 1, further comprising:

first protrusions formed on said inner surfaces of said wire connecting sections, said first protrusions protruding toward the power cord; and second protrusions formed on said inner surfaces of said connecting covers, said second protrusions protruding toward the power cord, said first and said second protrusions alternately positioned.

3. The power connector of claim 1, further comprising a terminal isolating plate interposed between said wire connecting sections.

4. The power connector of claim 1, further comprising outer case means for enclosing said power cord connecting means.

5. The power connector of claim 4, said outer case means comprising a case body having an opening upwardly and a case cover covering said case body, said case body and said case cover cooperatively having holes for receiving said power cords.

6. The power connector of claim 5, said case body comprising grooves each having the same cross-sectional shape as said power cord connecting means so as to allow each of said power cord connecting means to be received therein, respectively, in a state in which said power cord connecting means are electrically isolated from each other.

7. The power connector of claim 5, further comprising:

at least one locking projection formed on an outer surface of one of said case body and said case cover; and at least one locking hole formed on the other of said case body and said case cover, said locking hole positioned at a location corresponding to said locking projections in a manner such that said locking projection is locked into said locking hole when said case cover covers said opening of said case body.

8. The power connector of claim 5, with said case body and said case cover being made of a non-conductive resinous material and integrated with each other.

9. The power connector of claim 1, further comprising polarity indicating sections for indicating polarities of said power terminals, said polarity indicating sections formed on said front surface of said connector body.

10. The power connector of claim 9, wherein said polarity indicating sections are respectively coated with paints which have different colors.

11. A power connector for a microwave oven, comprising:

a connector body secured to a plate of a body of said microwave oven;

a first power terminal for a first voltage, said first power terminal projecting into said body of said microwave oven from a rear surface of said connector body;

a second power terminal for a second voltage, said second power terminal projecting into said body of said microwave oven from the rear surface of said connector body;

power cord connectors projecting from a front surface of said connector body toward an outside of said body of said microwave oven, each of said power cord connectors comprising a first connector and a second connector, each said first connector connected to each of said first and second power terminals, said first connector having a first concave portion, said second connector having a second concave portion corresponding to said first concave portion, said first concave portion and said second concave portion cooperatively making a round portion for receiving and holding the power cord; and an outer case detachably attached to said connector body and positioned outside of said microwave oven, said outer case enclosing said power cord connectors.

12. The power connector of claim 11, said first connector having a first protrusion protruding toward said second connector, said second connector having a second protrusion protruding toward said first connector, said first and said second protrusions alternately positioned.

13. The power connector of claim 11, said outer case having a pair of grooves each receiving respective power cord connectors, said grooves having the same shape as said power cord connectors so as to prevent said outer case from moving against said power cord connectors when said outer case encloses said power cord connectors.

14. The power connector of claim 11, further comprising a terminal isolation plate formed between said power cord connectors and protruding from said connector body.

15. The power connector of claim 11, further comprising a voltage indicator indicating said first voltage and said second voltage, said voltage indicator formed on the front surface of said connector body.

16. The power connector of claim 15, wherein said first voltage has a positive polarity while said second voltage has a negative polarity.

17. The power connector of claim 15, wherein said voltage indicator has different colors for said first voltage and said second voltage.

18. A power connector for a microwave oven, comprising:

a connector body secured to a plate of a body of said microwave oven, said connector body having a first slit and a second slit;

a first power terminal for a first voltage, said first power terminal inserted into said first slit;

a second power terminal for a second voltage, said second power terminal inserted into said second slit, each of said first and second power terminals having a first section positioned within said microwave oven and a second section positioned outside of said microwave oven, said first section being connected to a component within said microwave oven, said second section having a first concave portion, said first concave portion having first protrusions formed on an inner surface of said first concave portion;

a first cover coupled to said first power terminal and a second cover coupled to said second power terminal, each of said first and second covers having a second concave portion corresponding to said first concave portion, each of said first and second covers having a second protrusion formed on an inner surface of said second concave portion, said first concave portion and said second concave portion making a round portion for surrounding a power cord, said first and said second protrusions positioned alternately for improving connectability of the power cord with said power terminal; and an outer case detachably attached to said connector body, said outer case enclosing said first and second covers and said second sections of said first and second power terminals, said outer case having grooves receiving respective said first concave portions coupled with said second concave portion.

19. The power connector of claim 18, further comprising a voltage indicator indicating said first voltage and said second voltage, said voltage indicator formed on a front surface of said connector body.

20. The power connector of claim 19, further comprising an isolation plate formed on said connector body and extending outwardly between said first and second power terminals.

* * * * *